United States Patent [19]

Stumpp et al.

[11] 4,228,773

[45] Oct. 21, 1980

[54] DEVICE TO ACTIVATE AN ADJUSTING MEMBER IN DEPENDENCE ON LOAD

[75] Inventors: Gerhard Stumpp, Stuttgart; Gerhard Schielinsky, Schwaikheim, both of Fed. Rep. of Germany

[73] Assignee: Robert Bosch GmbH, Stuttgart, Fed. Rep. of Germany

[21] Appl. No.: 861,378

[22] Filed: Dec. 16, 1977

[30] Foreign Application Priority Data

Dec. 22, 1976 [DE] Fed. Rep. of Germany ..... 2658052

[51] Int. Cl.[3] ..... F02M 25/06; F02M 63/00

[52] U.S. Cl. ..... 123/505; 123/372; 123/459; 123/568

[58] Field of Search ..... 123/139 BG, 139 BD, 123/140 R, 140 A, 119 A

[56] References Cited

U.S. PATENT DOCUMENTS

| | | | |
|---|---|---|---|
| 1,962,448 | 6/1934 | Kreuzer | 123/139 BG |
| 2,025,723 | 12/1935 | Chandler | 123/139 BG |
| 2,502,679 | 4/1950 | Stanly | 123/139 BG |
| 2,902,018 | 9/1959 | Schlichtenmayer | 123/139 BG |
| 2,985,158 | 5/1961 | Wood-Collins | 123/139 BG |
| 3,946,713 | 3/1976 | Laufer | 123/139 BD |
| 4,031,873 | 6/1977 | Banzhaf et al. | 123/139 BG |
| 4,114,579 | 9/1978 | Stumpp | 123/139 BG |

*Primary Examiner*—Charles J. Myhre
*Assistant Examiner*—Andrew M. Dolinar
*Attorney, Agent, or Firm*—Edwin E. Greigg

[57] ABSTRACT

A device which serves to activate an adjusting member in dependence on load, in which especially the cross section and/or the pressure differential of an exhaust gas return line which is provided in the intake manifold of an internal combustion engine can be altered in dependence on the load. A fuel injection pump of a known construction is associated with the internal combustion engine, and includes a rate adjusting element, the position of which serves as the control value for the load. This control value, together with a subsequently arranged amplifier device for the control value, produces an adjusting value for the activation of the adjusting element.

21 Claims, 9 Drawing Figures

27
23
15
16
50
P 52
15
18
16
51
24

DEVICE TO ACTIVATE AN ADJUSTING MEMBER IN DEPENDENCE ON LOAD

BACKGROUND OF THE INVENTION

The invention relates to a device for load-dependent activation of an adjusting member in an internal combustion engine provided with a fuel injection pump and which further includes a fuel rate adjusting element that is adjustable according to the load. In a known device of this type the pressure in the intake manifold is changed in dependence on the load, causing a load-dependent activation of an injection timing adjustor that is acted upon by pressure in the intake manifold of a divider injection pump. This is made possible because the load-dependently adjustable centrifugal force regulating sleeve which activates the rate adjusting element of the injection pump has an outflow opening that is variable as to its effective cross section. By means of this device, the pressure in the intake manifold may be substantially affected. With this device it can also be accomplished that when there is no substantial adjusting pressure differential for a supplementary load-dependent activation of an adjusting element outside of the injection pump, there is no negative influence on the precision of the injection timing adjustment and the injection rate adjustment.

OBJECTS AND ADVANTAGES OF THE INVENTION

The structure disclosed herein has the advantage that large load-dependent adjusting forces can be produced in order to load-dependently activate an adjusting element provided outside of the injection pump without causing any adverse effects on the fuel rate control.

In addition, a further advantage of this invention is that a throttle means having an adjustable cross section which corresponds to the position of the rate adjusting element of the injection pump serves as a displacement pickup to control a pressure medium rate from a source which serves as an amplifying device. Pressure in an operating pressure chamber of a servo-type motor is controlled by means of an adjustable piston, a return spring and an outflow throttle.

Furthermore, in a particularly advantageous embodiment of the invention, a differential pressure valve is provided that is arranged parallel to the throttle and an outflow throttle which relieves the operating pressure chamber, the cross section of the latter being variable to correspond to the position of the adjusting piston. Accordingly, in this manner, a pressurized fluid flow is obtained that is proportional to the load-dependent modified cross section.

In another embodiment of the invention, an additional differential pressure valve is provided that is arranged parallel to the outflow throttle. This achieves in a very advantageous novel manner a proportional positioning of the outflow throttle cross section, that is, the adjusting piston which corresponds to the load-dependently modified cross section of the throttle means with even the smallest use of the pressure means. The result is an exact following of the adjusting piston despite interfering forces such as different frictional resistances.

According to the invention, it is especially advantageous that the servo-type motor is connected with a throttle element provided in an exhaust gas return line that extends to the intake manifold of the internal combustion engine. In this manner, an exact loaddependent control of the exhaust gas return rate can advantageously be obtained, in order for example when one desires during full-load operation to obtain a maximum performance of the internal combustion engine, to cut off the exhaust gas return and in partial-load ranges to obtain an optimal decrease of nitrogen oxide, soot, carbon monoxide and hydrogen portions in the exhaust gases of the internal combustion engine.

Other objects and advantages of the present invention will be more readily apparent from a further consideration of the following detailed description of the drawings illustrating several exemplary embodiments of the invention.

BRIEF DESCRIPTION OF THE DRAWINGS

There are disclosed herein nine exemplary embodiments of the invention and in further detail.

DESCRIPTION OF THE PREFERRED EMBODIMENTS

A return of controlled exhaust gas quantities to the intake manifold of an internal combustion engine has proven itself as an effective means to decrease the portion of harmful substances emitted by the exhaust stream of the internal combustion engine. Despite various known regulating and/or control devices for returning exhaust gases to the intake manifold the requirement remains to make such devices as simple and reliable as possible. This is especially true with small motor vehicles for a control that is adequate for the exhaust gas return should be striven for that is as inexpensive and simple as possible and yet still is sufficiently effective. A load-dependent adjustment of the cross section of the exhaust gas return is especially suitable therefor as can be seen from the embodiments of the invention enumerated hereinafter. By utilization of the present invention, the exhaust gas return is interrupted in full-load operation in order to achieve a maximum output performance of the internal combustion engine in this range. In other or partial-load ranges, good exhaust emission values are striven for when the rate of exhaust gas return is approximately proportional to the load.

Figure 1:
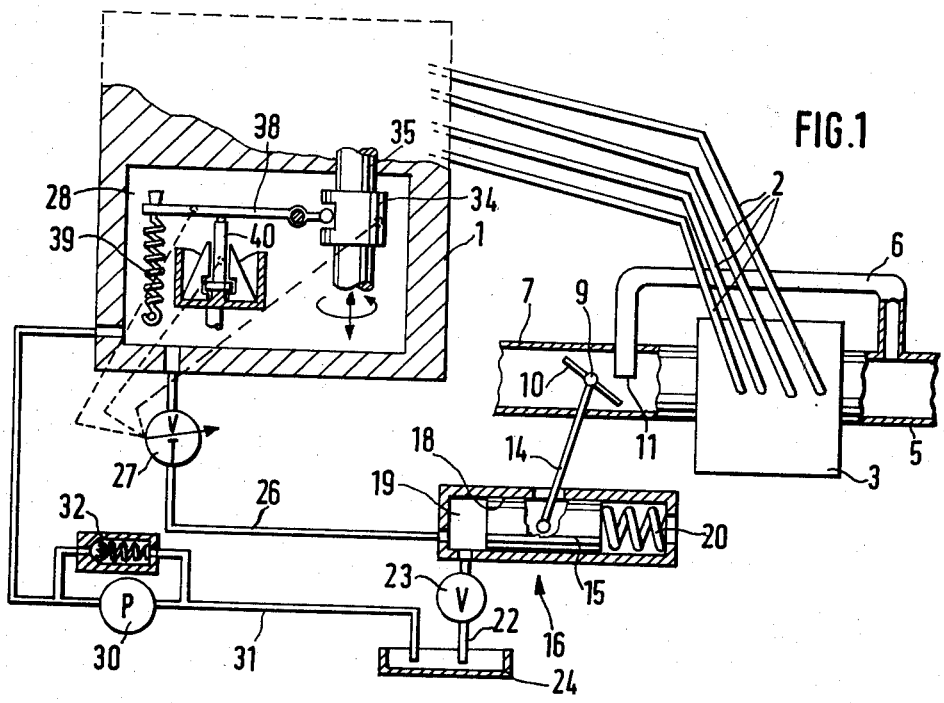
FIG. 1 discloses schematically the first embodiment of the invention wherein a hydraulic servo-type motor, which is connected with a throttle device in an exhaust gas return line to the intake manifold of the internal combustion engine, and which receives pressurized fluid from the interior chamber of an injection pump by means of a cross-sectional flow area controlled in accordance with the position of a rate adjusting element of an injection pump.

Turning now to the drawings, there is shown in FIG. 1 an injection pump generally indicated at 1 which supplies an internal combustion engine 3 with fuel by means of lines 2. An exhaust gas return line 6 leads from the exhaust manifold line 5 of the schematically illustrated internal combustion engine to the intake manifold 7 downstream of the first throttle valve 10 which is positioned in the intake manifold. The portion of the throttle valve 10 that lies downstream of its supporting shaft 9 is arranged to control the exit opening 11 of the exhaust gas return line 6 and is adapted to be closed during full-load conditions. The throttle valve influences both the cross section of the exit opening and the pressure differential at this opening. The shaft 9 of the first throttle valve 10 is mechanically connected with an element, which is an adjusting piston 15 by means of a rod 14 that extends into a servo type motor 16. The adjusting piston 15 is adapted to enclose an operating pressure chamber 19 in a closed cylinder 18 and is loaded on its opposite end wall by a pressure spring 20, with the servo motor 16 being opened to atmosphere as shown.

The aforesaid pressure chamber 19 is connected with a fuel tank 24 by means of a relief line 22 with a throttle valve means being interposed between the pressure chamber 19 and the fuel tank 24. In addition, a connection is also provided for between the operating pressure chamber 19 and the suction chamber, i.e., fuel-filled inter-chamber of the injection pump, this connection being formed by a line 26 in which an adjustable second throttling means 27 is provided.

The injection pump is of a known type and includes a suction chamber which is provided with fuel from the fuel tank 24 with the aid of a fuel supply pump 30 that is positioned in a fuel supply line 31. As shown in the drawing in FIG. 1, a pressure regulating valve 32 is interposed in the fuel line 31 that extends from the fuel tank 24 to the fuel injection pump 1 and is arranged parallel to the fuel supply pump 30. The injection pump schematically shown in the drawing in FIG. 1 is a distribution injection pump of known construction in which the stroke of the pump piston 35 is determined by the position of a distributing slide valve 34 as a rate adjusting member. By referring at this time to FIG. 2, it will be noted that the pump operating chamber, which is not shown in detail, is connected with a suction chamber 28 by means of a release channel 36. In this manner, the fuel supply to the internal combustion engine can be controlled. According to the structural principles of this distribution-type injection pump, the pump piston as depicted by the arrows position therebeneath carries out a reciprocating and simultaneously rotating motion. The setting of the distributing slide valve 34 takes place in a known manner by means of a centrally mounted lever 38 which is connected on one end with the distributing slide valve 34 and the other end of which is arranged to be acted upon by at least one regulating spring 39 having an adjustable tension. The regulating sleeve 40 of the centrifugal governor, which is indicated generally by the reference numeral 42, acts against the lever 38 in a known manner counter to the force of the spring 39. This lever 38 can be adjusted by flyweights 41 which are driven at a rate proportional to the pump rpm. Depending on the tension of the regulating spring 39, the sleeve 40 is displaced to a greater or lesser degree at a given rpm so that the distributing slide valve 34 also takes a higher or lower position relative to the pump piston 35. The position of the adjusting structure comprised of sleeve 40 as well as that of the lever 38 and the distributing slide valve 34 set a measurement for the adjusted fuel supply rate, that is, for the load.

As is appropriately indicated by the broken lines in FIG. 1, the cross section of the second throttling means 27 can be adjusted in dependence upon the load according to the position of the distributing slide valve 34, the lever 38 or the sleeve 40. This type of adjustment can be carried out by an adjustment means without any adverse reaction in other mechanical or electrical components.

Figure 2:
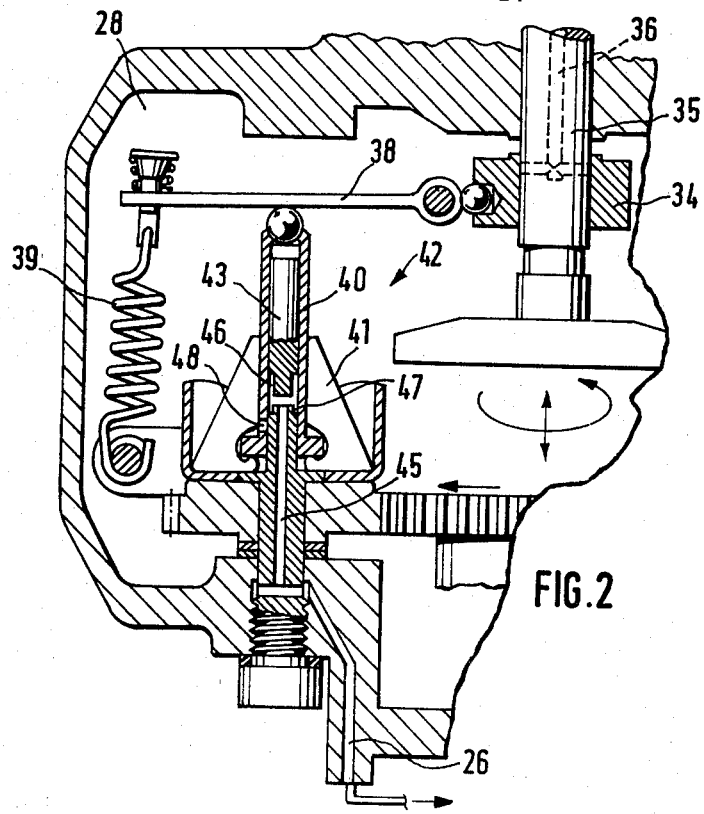
FIG. 2 is a schematic view of an injection pump in which is disclosed a throttle means to control the pressurized fluid.

In FIG. 2 there is shown another embodiment of the invention that is utilized for the production of mechanical reaction-free control values. Furthermore, in this embodiment, the carrier 43, upon which the regulating sleeve 40 is shiftable by means of the flyweights, has an axial bore that is arranged to communicate with an annular groove 46 which in turn connects with the line 26 that leads to the operating pressure chamber 19 of the servo-type motor 16. A limiting edge of the annular groove 46 serves as a control means 47 which depending upon the position of the regulating sleeve 40 is arranged to reveal a larger or smaller area of a slit 48 in the wall of the regulating sleeve 40 which leads to the suction chamber 28 of the fuel injection pump.

By means of this arrangement, an area can be opened that is proportional or inversely proportional to the load, depending upon the relation of the annular groove 46 to the slit 48 and fuel can flow out of this slit depending upon its opened area from the suction chamber to the operating pressure chamber 19 of the servo-type motor. The flow area thereby represents a control value that is produced with no adverse reactions which is amplified and transformed into an adjusting value in a pressure fluid flow. The rate of fuel flow through the connecting line 26 which is controlled by the outflow throttle valve 23 causes a pressure in the operating chamber 19 that is dependent upon the load corresponding to the area of the opening of the second throttling means 27. In the embodiment shown in FIG. 1, the area of the first throttling means is adjustable proportionally to the load and is moved according to the first throttle valve 10 by the servo type motor 16.

Figure 3:
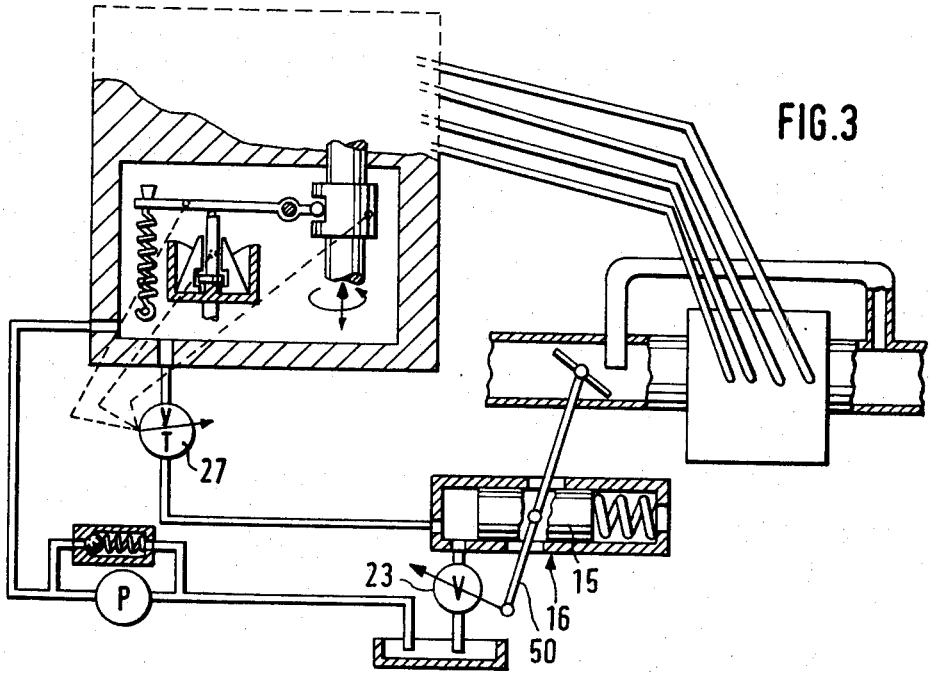
FIG. 3 is another exemplary embodiment of the invention provided with a load-dependent variable throttle in a connecting line that extends from the suction chamber of the injection pump to the operating pressure chamber of the hydraulic servo-type motor and with an outflow throttle controlled by the servo-type motor to relieve the operating pressure chamber.

The embodiment of the invention according to FIG. 3 includes substantially the same components as the embodiment of the invention according to FIGS. 1 and 2 and the description of this new figure will only make reference to the modified elements and for a better understanding of the invention, reference may be made to the earlier description. In contrast to the embodiments of the invention shown in FIGS. 1 and 2, the outflow throttle valve 23 of FIG. 3 has a variable cross section which, as shown schematically, is changed according to the position of the adjusting piston 15 of the servo-type motor 16. Contrary to the above explanary embodiment according to FIG. 1, in which the position of the adjusting piston 15 was substantially influenced by the stiffness of the return spring 20, in this concept the load-dependent adjustment of the adjusting piston 15 is more precise because the follow-up adjustment of the adjusting piston 15 that corresponds to the cross section of the second throttling means 27 is made more linear by the following of the outflow throttle cross section.

Figure 4:
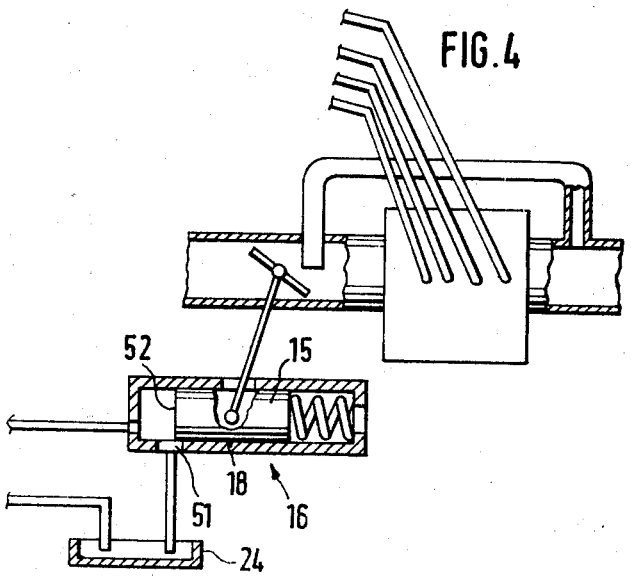
FIG. 4 is a schematic view of another embodiment of the invention disclosing a modification of the outflow throttle.

While FIG. 3 schematically shows the adjustment of the cross section of the outflow throttle 23 by means of the shaft or rod means 50, FIG. 4 shows a further advantageous embodiment of the variable outflow throttle 23. For a better understanding of the schematic structure of FIG. 4, reference should be made to the discussion hereinbefore relative to FIG. 1. The principal differences in the structure in FIG. 4 over those earlier described herein are that the cylinder 18 of the servo-type motor 16 has a slit 51 which is controlled by the frontal surface 52 of the adjusting piston 15. By use of this slit 51 in this embodiment, one can obtain a linear relation of the cross section of the outflow from the cylinder 18 into the fuel tank 24 by the position of the piston 15. Further adaptations of this concept can be taken by appropriately forming the shape of the curve at the slit 51 and by proper selection of the spring stiffness.

Figure 5:
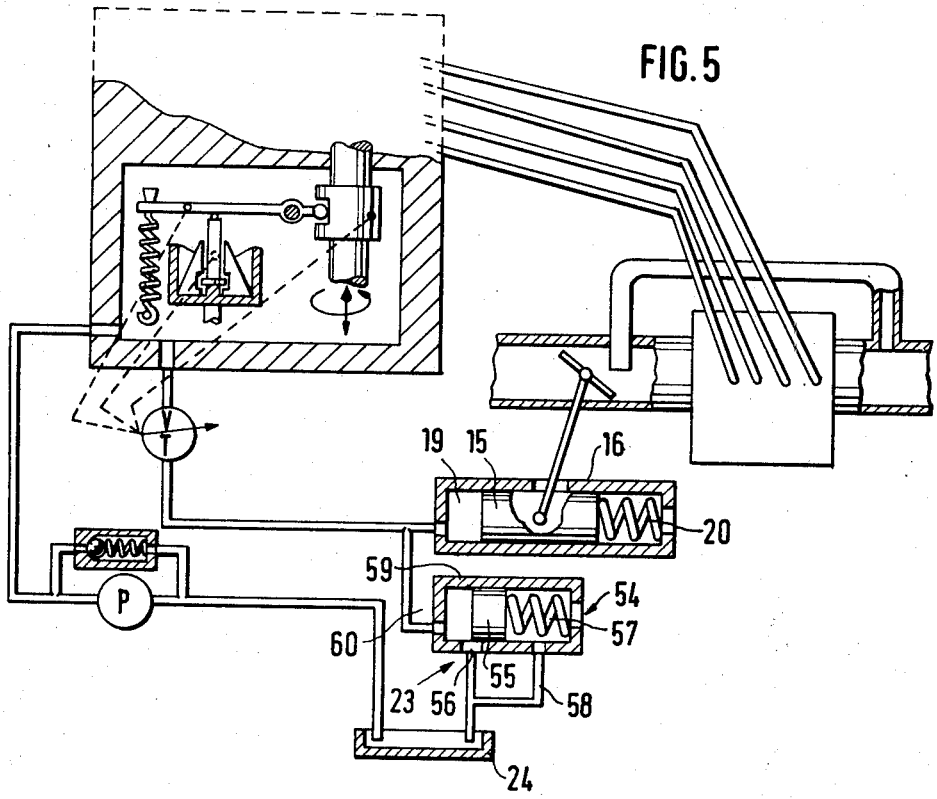
FIG. 5 is a schematic view of another embodiment of the invention in which an outflow throttle is actuated by a pressure control valve.

FIG. 5 shows an embodiment of the invention that is supplementary to the embodiment disclosed in FIG. 4. In this structure the operating pressure chamber 19 is connected with a pressure regulating valve 54. The cylinder 59 is provided with an outflow opening 56 which is controlled by a spring loaded piston 55 of the pressure regulating valve and is utilized here with the outflow throttle valve 23 being arranged to have a variable cross section. In this embodiment, the pressure regulating valve 54 is constructed in principle the same as the servo-type motor 16. The piston 50 is slidably positioned in the cylinder 59 and includes a frontal surface that forms a chamber, as shown, that is relieved of pressure by a line 58 and further includes a rear wall that is loaded by a stiff spring 57. This chamber 60 is connected by a line with the operating pressure chamber 19 and further includes the controlled opening 56 that leads to the fuel tank 24. In this embodiment of the invention the outflow throttle 23 can be built quite small if, for example, the spring 57 is constructed of stiff material. With the use of a softer spring 20, in the servo-type motor actuator 16, allows for substantially larger adjusting movements of the adjusting piston 15 under similar pressure changes.

Figure 6:
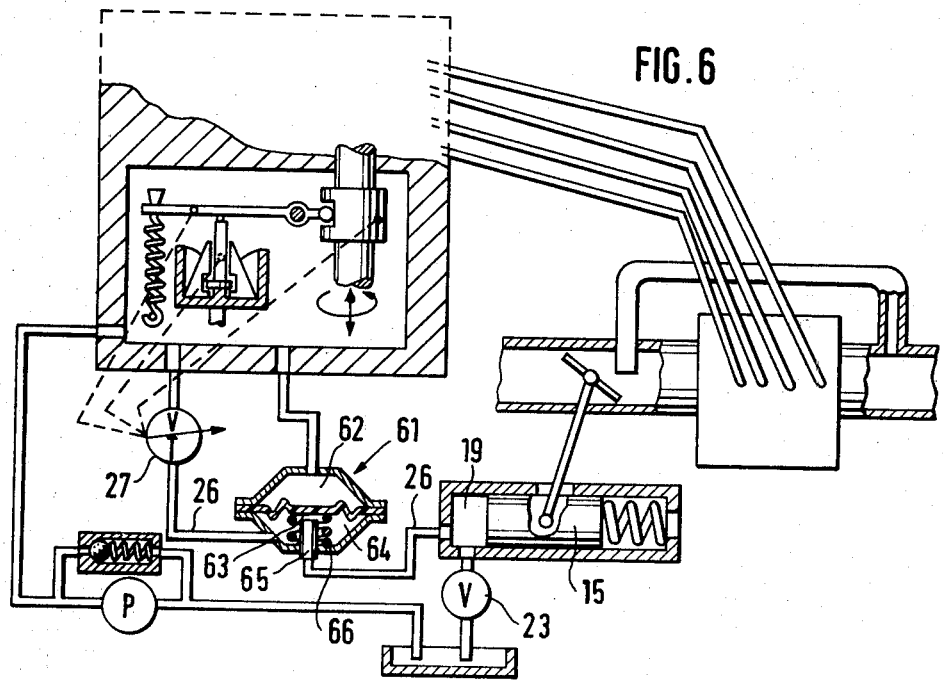
FIG. 6 is a still further schematic view of another exemplary embodiment of the invention which is a modification of that shown in FIG. 1 and in this view is provided with a differential pressure control valve arranged parallel to the throttle means in the connecting line which extends to the operating pressure chamber of the servo-type motor.

For a better understanding of the embodiment of the invention depicted in FIG. 6, reference is made at this time to the disclosure of FIG. 3, since in the structure of FIG. 6 there is an additional characteristic of a differential pressure valve 61 which is located parallel to the second throttling means 27. The differential pressure valve includes a reference pressure chamber 62 which is connected with the pump suction chamber 28 and is separated from the controlled pressure chamber 64 by a diaphragm 63. In a known manner, a pressure spring 66 that acts on the diaphragm 63 is arranged in the controlled pressure chamber. In addition, a line 65 is adapted to project into the pressure chamber and arranged to have its end opening controlled by the diaphragm. Also, the connecting line 26 which in turn extends from the second throttling means 27 empties into the controlled pressure chamber 64 and flow continues through this chamber into the operating pressure chamber 19.

By means of this embodiment, a definite pressure differential which is determined largely by the pressure spring 66 is maintained at the opening cross section of the second throttling means 27. The pressurized fluid which flows in the line 26 to the operating pressure chamber 19 is therefore directly proportional to the flow cross section at the second throttling means 27. Accordingly, the adjustment of the piston 15 can proceed with correspondingly improved precision. Because of the small pressure differential at the second throttling means 27, which is precisely regulated by the differential pressure valve 61, the mean throttle cross section can be held relatively large and this achieves precise regulation, that is, allows a small throughput of the pressure fluid.

A further improvement of the load-dependent control of the servo-type motor can be achieved according to FIG. 6 when the cross section of the outflow throttle means 23 is moved according to the position of the piston 15 as shown by the exemplary embodiment in FIGS. 3 through 5. In this manner, the hysteresis of the servo-type motor is influenced only by its friction, that is by outside disturbing forces.

Figure 7:
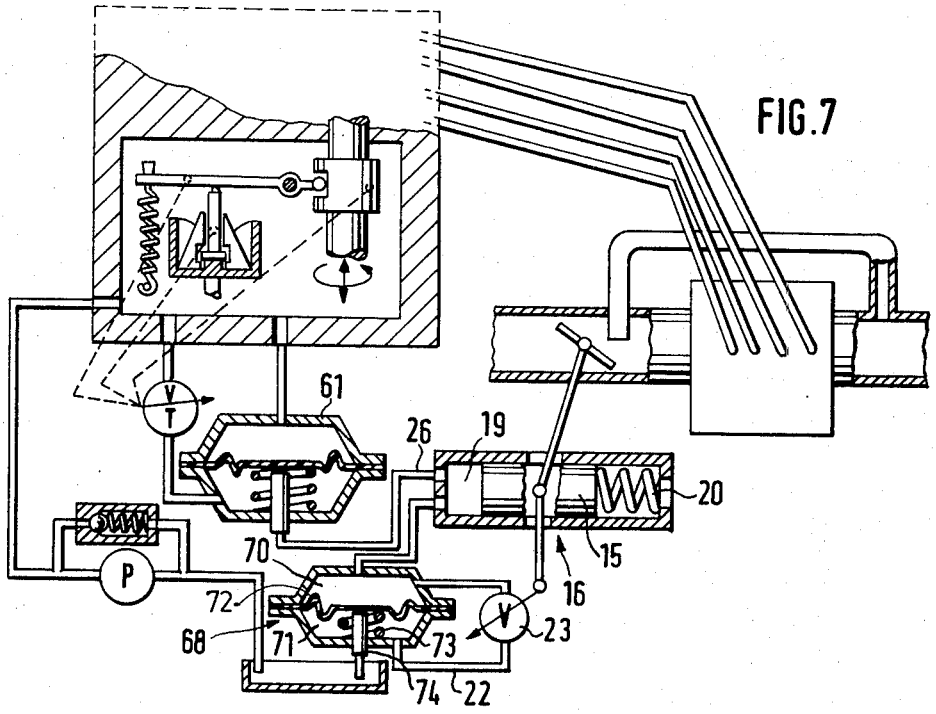
FIG. 7 is another schematic view of an embodiment of the invention which is a further modification of that shown in FIG. 6 and is provided with a differential pressure valve arranged parallel to the outflow throttle.

The concept that is disclosed in the embodiment in FIG. 7 basically corresponds to the development according to FIG. 6, but has the further distinction that, as mentioned above, the outflow throttle means 23 is varied according to the position of the piston 15 and that a second differential pressure valve 68 is arranged in parallel with the outflow throttle means 23. This valve has substantially the same construction as the differential pressure valve 61 shown in FIG. 6. The reference pressure chamber 70 shown in FIG. 7 is connected with the operating pressure chamber 19 of the servo-type motor 16. The relief line 22 which contains the outflow throttle means 23 leads either through the reference pressure chamber or directly from the operating pressure chamber 19 and joins the control pressure chamber 71 in an unclosable manner downstream of the outflow throttle means 23. A pressure spring 73 is arranged in the controlled pressure chamber 71 and loads a diaphragm 72 positioned between the reference pressure chamber and the controlled pressure chamber. The diaphragm 72 and the mouth of a conduit 74 forms a valve in the chamber 71.

METHOD OF OPERATION OF THE STRUCTURE SHOWN IN FIG. 7

By means of the pressure differential that is constantly regulated at the cross section of the second throttle, with the aid of the second differential pressure valve 61, there results a flow rate in the connecting line 26 that extends to the operating pressure chamber 19 of the servo-type motor which is proportional to the opening cross section of the second throttle. When the cross section of the second throttle is enlarged from its stationary condition, there is an increase in the flow rate. When the cross section of the outflow throttle means 23 is constant, this increased flow rate leads to a pressure increase in the operating pressure chamber 19. Accordingly, the piston 15 is shifted against the spring 20 long enough to allow the fuel flow rate through the changing cross section to equal the fuel flow rate flowing through the second throttle. Because the pressure differential at the cross section of the outflow throttle 23 is regulated to a constant value, the cross section of the outflow throttle proportionately follows the cross section of the second throttle, and in addition, the piston 15 is adjusted proportionally to the cross section of the second throttle. Thus, in this manner, the influence of disturbing forces, such as various friction influences along the adjusting path of the piston, are excluded. This design thereby achieves a precise proportionality of the adjusting path of the servo-type motor to the control value which is obtained as a load signal in the regulator of the injection pump. Furthermore, even very small pressure fluid quantities per unit of time with relatively large cross sections at the second throttle and the overflow throttle are sufficient to exclude an influencing of the regulating processes of the fuel injection pump by pressure fluctuations in the suction chamber 25. The pump 30 that supplies the fuel injection pump can accordingly be provided with a decreased performance.

As a rule there is also a rapid change in the fuel flow rate needed to be supplied to the internal combustion engine when there is a rapid load change and a corresponding actuation of a gas pedal of the internal combustion engine. If the fuel supply pump 30 has only a small capacity then it could result in a short-lived pressure fall in the suction chamber 20 of the injection pump, or conversely, in a slow following regulation of the exhaust return rate, that is, the intake of fresh air corresponding to this operating condition. Should it happen, as is shown in the above embodiments of this invention, the cross section of the exhaust gas return line and the cross section of the air induction tubes through which the internal combustion engine is furnished with fresh air are changed complementally to each other, then when the hysteresis of the servo-type motor 16 is too great an over-enrichment of the operating mixture would result, with corresponding increased proportions of soot being emitted in the exhaust.

Figure 8:
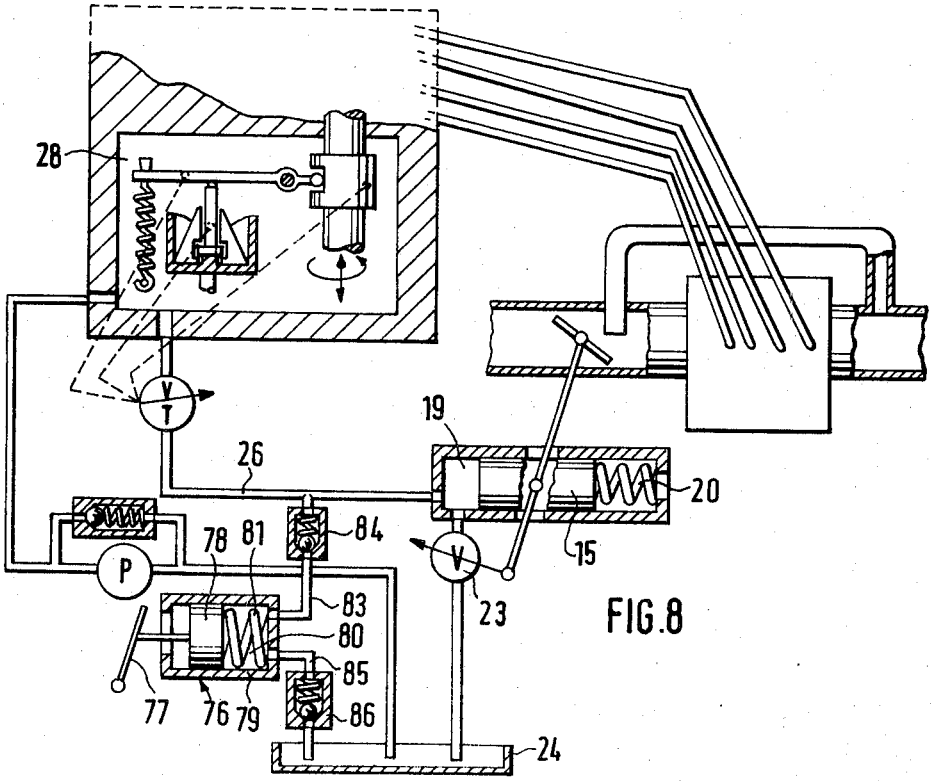
FIG. 8 is yet another exemplary embodiment of the invention including the modification of that disclosed in FIG. 3 and includes an acceleration pump for temporary rapid adjustments of the throttle member in the closing direction in the exhaust gas return line, when a rapid acceleration movement of the gas pedal takes place.

According to the exemplary embodiment of the invention disclosed in FIG. 8, this over-enrichment of the operating mixture is prevented by including in the system an acceleration pump 76 which is directly coupled to the gas pedal 77. The arrangement of elements according to FIG. 8 is constructed substantially in the same manner as that shown in FIG. 3 and one should refer to that figure for its reference numerals when reading the discussion that applies to FIG. 8. As indicated earlier herein, the device is so arranged that as the load increases in the operating pressure chamber 19 there is a resultant increase in adjusting pressure and the piston 15 is thereby shifted against the force of the spring 20 in the closing direction of the exhaust return line thereby opening the intake cross section of the air induction tube. In order to accelerate this movement during a rapid operation of the gas pedal 77 the acceleration pump, which comprises a piston 78 encloses in a closed chamber 79 both a pump chamber 80 and a pressure spring 81. Also as shown in FIG. 8, a pressure line 83 extends from the chamber 80 to the connecting line 26 and thus to the operating pressure chamber 19. In the pressure line 83 a non-return valve 84 is arranged which opens in the direction of the operating pressure chamber. When the gas pedal 77 is displaced, the piston 78 is shifted against the force from the spring 81 and fuel is pumped into the operating pressure chamber 19 and by reason of this, the piston is first brought into an unregulated position which corresponds to a substantially increased load. However, in the period of time which follows after the introduced increased amount of fuel has passed out through the throttle 23, the correct position which corresponds to the load is again set. In this manner, one obtains a short-term leaning of the fuel mixture by means of which a formation of soot is prevented in every instance. The pumping chamber 80 is refilled from the fuel tank by means of a suction line 85 in which a non-return valve 86 is arranged to open in the direction of suction when the piston 78 is being returned by the pressure spring 81. In this manner, one advantageously obtains a sufficiently rapid adjusting speed of the servo-type motor while only expending a minimum of performance of the fuel supply pump 30, that is, low allowable adjusting fluid quantity per unit of time.

If the logic of the servo-type motor is reversed then the return spring 20 moves the piston 15 in the operating pressure chamber, in the absence of pressure into a position in which the throttle valve 10 closes the cross section of the exhaust gas return line 6 then the piston 15 must be capable of performing a rapid closing movement during a rapid increase of the injection rate or the load. According to the embodiment of the invention disclosed in FIG. 9, the operating pressure chamber 19 receives an adjusting pressure from the injection pump that falls as the load increases by reason of the changing cross section of the second throttle 27 which is decreased under an increasing load. Accordingly the cross section of the outflow throttle 23 is regulated by the piston 15. In addition, a pressure relief channel 88 which extends from the operating pressure chamber 19 to the fuel tank 24 is under control of a piston 91 slidably positioned in the pump valve assembly 89. This pump valve assembly is activated by the accelerator pedal during a load increase. The pump valve assembly is also formed as a slide valve and includes a cylinder 90 that is closed at one end. The cylinder 90 is provided with a closing member or piston 91 which is urged into a rest position against a stop 93 by a pressure spring 92. The closed end of the chamber 87 which contains the spring 92 is relieved of pressure by means of a line 94 that empties into the fuel tank 24. It will be noted that a pressure relief channel 88 is in communication with an aperture in the wall of the cylinder and when the piston 91 is in its rest position the relief line and the channel are closed. The means defining these openings can be opened immediately after an adjustment of the piston member against the force of the pressure spring 92. The piston member has in addition an axial throttle channel 95 which connects the channel chamber 87 with a chamber 97 in front of the piston 91. The chamber 87 is enclosed by a second piston 98 that is arranged in tandem in the cylinder 90. The piston 98 is urged against a stop 100 by a pressure spring 99 that is supported on the first stop 93 and is connected with the accelerator pedal by means of a rod 101.

OPERATION

In reaction to a rapid accelerator pedal movement the piston 98 is also rapidly displaced as is the piston 91 because the throttling effect of the throttle channel 95 does not allow the pressure in chamber 97 to be relieved quick enough. Thus the passage of the pressure relief channel 88 is accordingly opened so that there will occur a rapid depressurization of the operating pressure chamber 19 of the servo-type motor 16. Within a short time, there is then a pressure equalization provided for between the respective chambers 97 and 87 by means of the throttling effect of channel 95 so that the piston 91 again abuts the stop 93 and the pressure relief channel 88 is consequently closed. The pump valve assembly 89 therefore has a differentiating effect in that it reacts to rapid movements of the accelerator pedal and achieves a rapid temporary depressurization of the operating pressure chamber 19 according to the effected load increase. As is described in the above example, the opening of the exhaust gas return line is also temporarily closed more than it would be under conditions of the corresponding load. After the pressure relief channel is closed, the load conforming after regulation takes place.

Figure 9:
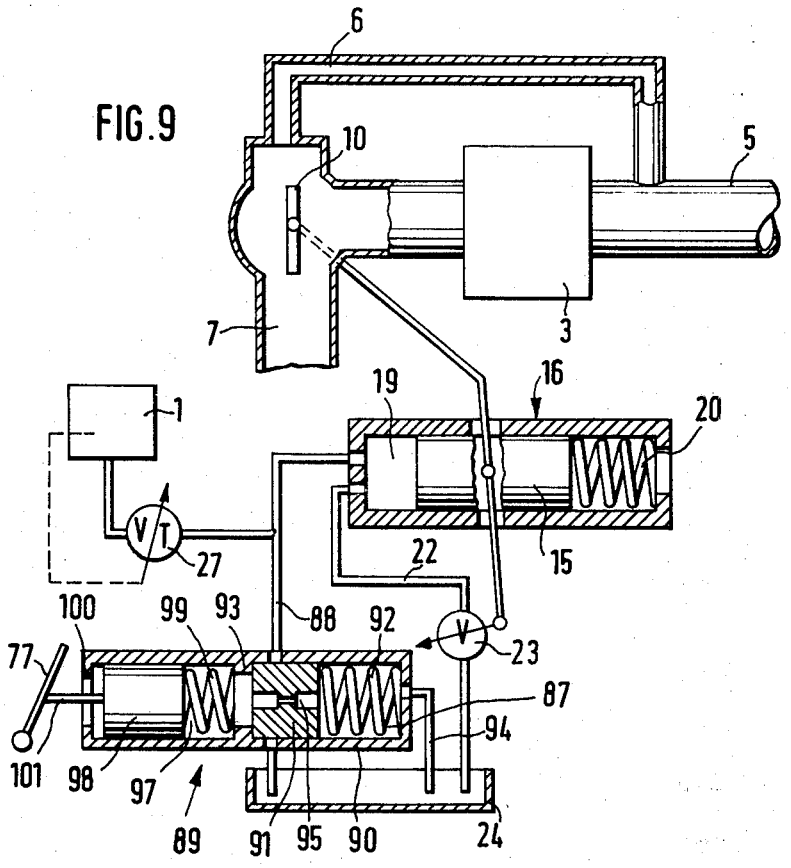
FIG. 9 is still another exemplary embodiment of the invention showing schematically an adaptation of the concept of FIG. 3 and further includes a differentiating valve that reacts to an accelerating movement of the gas pedal located in the pressure relief line of the operating pressure chamber of a servo-type motor that closes the exhaust gas return line in the rest position.

The throttle valve 10 shown in the described embodiments of the invention according to FIG. 9 also can be constructed as a three-way valve in which the fresh air and exhaust gas return cross sections are changed complementarily to each other. However, as mentioned above, the embodiments of the invention disclosed herein are not limited to those shown. Other load-dependent controls can be used with the described invention in lieu of the exhaust gas return control. Also, the suction chamber of the fuel injection pump does not have to be the pressure source, especially when higher adjusting pressures are necessary. By means of an appropriate mechanical/electrical or mechanical/hydraulic converter a different pressure medium can be used. Further, the path of the regulating sleeve can for example also be detected by an electrical indicator thereby obtaining a load-dependent electrical control value, with which the servo-type motor can be adjusted by means of corresponding amplifying devices.

The servo-type motor for example might be an operating magnet. In addition, a pressure fluid flow to a hydraulic motor can be controlled with an electrically obtained control signal by means of magnetic valves. This arrangement also provides for a load-dependent adjusting device without any adverse effects on the fuel injection rate control, that is, regulation.

The invention is also not limited to the use of a distribution type fuel injection pump. The regulating rod of a series injection pump or a corresponding pickup on the governor can be employed to form the control values. In the exemplary embodiments according to FIGS. 6 and 7, which are described in detail in the specification, an additional correcting engagement is obtained by changing the spring tension in the differential pressure valve corresponding to the operating parameters of the internal combustion engine.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection system for an internal combustion engine, comprising in combination:

a. an intake manifold through which an air flow is established;

b. an exhaust gas line through which an exhaust gas flow is established;

c. an exhaust gas recycling line connected to the exhaust gas line and to the intake manifold; the intake manifold connection defining therein a discharge outlet of the recycling line;

d. a first throttle valve controlling the flow of the exhaust gas in the recycling line;

e. fuel injection pump having a fuel rate adjusting structure which is adjustable according to engine rpm;

f. a servomotor including an adjusting element, an operating pressure chamber, a return means to provide a biasing force and means connecting the adjusting element to the first throttle valve for controlling the opening thereof;

g. a fuel line connecting the fuel injection pump and the servomotor through which a flow rate is established where the flow rate determines the actuation of the servomotor;

h. a second throttle valve located in the fuel line having an actuating means wherein the second throttle valve is connected to the fuel rate adjusting structure by the actuating means, such that the second throttle is controlled according to engine rpm by the fuel rate adjusting structure to determine the flow rate in the fuel line.

2. The fuel injection system as defined in claim 1, having a slide valve to indicate engine rpm by position of the slide valve, wherein the adjusting structure is comprised of the slide valve.

3. The fuel injection system as defined in claim 1, having a lever to indicate engine rpm by position of the lever, wherein the adjusting structure is comprised of the lever.

4. The fuel injection system as defined in claim 1, having a sleeve to indicate engine rpm by position of the sleeve, wherein the adjusting structure is comprised of the sleeve.

5. In a fuel injection system as defined in claim 1, wherein the first throttle valve is mounted within the intake manifold upstream of and in operative association with the discharge outlet of the recycling line such that the first throttle valve is arranged to control the exhaust gas flow in the recycling line complimentarily to the air flow in the intake manifold.

6. In a fuel injection system as defined in claim 1, wherein the adjusting element is a piston operable within the operating pressure chamber.

7. In a fuel injection system as defined in claim 6, wherein the return means is a spring.

8. In a fuel injection system as defined in claim 1, wherein the fuel injection pump has a suction chamber, further including a sleeve means which surrounds a carrier such that the sleeve means and carrier form a slide valve which opens to the suction chamber.

9. A device according to claim 8, further characterized wherein said second throttle valve is disposed in parallel relation with a pressure differential valve having plural chambers and while one of said chambers is in fluid communication with the suction chamber of said fuel injection pump, another of said chambers is in fluid communication with the operating pressure chamber.

10. A device according to claim 9, further characterized wherein said differential pressure valve includes a regulating spring means.

11. In a fuel injection system as defined in claim 1, wherein the operating pressure chamber has an outflow throttle means adapted to provide pressure relief for said operating pressure chamber.

12. A device according to claim 11, further characterized wherein said outflow throttle means has an adjustable cross section.

13. A device according to claim 12, further characterized wherein the adjustment of the outflow throttle means is dependent upon said adjusting element.

14. A device according to claim 12, further characterized wherein said outflow throttle means further includes a pressure regulating valve provided with a piston and a spring means, said pressure regulating valve further including means defining a discharge opening controlled by said piston.

15. A device according to claim 12, further characterized wherein said outflow throttle means is disposed in parallel relation with a differential pressure valve, said differential pressure valve including plural chambers with a first of said chambers in fluid communication with said operating pressure chamber and the second of said chambers in fluid communication with said outflow throttle means.

16. A device according to claim 14, further characterized wherein said differential pressure valve includes a regulating spring means.

17. A device according to claim 13, further characterized wherein said outflow throttle means further includes a throttle member that is mechanically coupled with said adjusting element.

18. A device according to claim 13, further characterized wherein said adjusting element includes a frontal control edge arranged to cooperate with an outflow opening in said pressure chamber and forming a variable throttle means.

19. A device according to claim 1, wherein said operating pressure chamber is connected with a pump valve assembly means through a line provided with a non-return valve means, said pump valve assembly further including a line provided with a non-return valve means that leads to a fuel tank and said adjusting element is influenced by said return spring to enlarge the cross section of said exhaust gas return line.

20. A device according to claim 1, wherein the second throttle valve is connected by a line to said operating pressure chamber and to a pump valve assembly, and said adjusting element of said servo-type motor is acted upon by said return means to close said exhaust gas recycling line while simultaneously controlling said outflow throttle means.

21. A device according to claim 20, further characterized wherein said pump valve assembly includes first and second tandemly disposed pistons which are urged toward first and second stop means by respective spring means, said first piston being operatively connected with an accelerator pedal of the internal combustion engine and said second piston being adapted, when urged into its rest position against one of said stop means, to control access to a relief channel that extends from the operating pressure chamber to said pump valve assembly.

* * * * *